US009643217B2

(12) United States Patent
Chien et al.

(10) Patent No.: US 9,643,217 B2
(45) Date of Patent: May 9, 2017

(54) IN SITU CLEAN APPARATUS AND METHOD THEREOF

(71) Applicant: TAIWAN SEMICONDUCTOR MANUFACTURING COMPANY LTD., Hsinchu (TW)

(72) Inventors: Li-Hsing Chien, Hsinchu County (TW); Yung-Ti Hung, Hsinchu (TW); Rouh Jier Wang, Hsinchu (TW); Yu-Te Chang, Hsinchu County (TW)

(73) Assignee: TAIWAN SEMICONDUCTOR MANUFACTURING COMPANY LTD., Hsinchu (TW)

( * ) Notice: Subject to any disclaimer, the term of this patent is extended or adjusted under 35 U.S.C. 154(b) by 678 days.

(21) Appl. No.: 14/057,492

(22) Filed: Oct. 18, 2013

(65) Prior Publication Data

US 2015/0107623 A1 Apr. 23, 2015

(51) Int. Cl.

*B08B 3/02* (2006.01)
*B08B 9/027* (2006.01)
*B08B 9/00* (2006.01)

(52) U.S. Cl.

CPC ..... *B08B 3/02* (2013.01); *B08B 9/027* (2013.01); *B08B 9/00* (2013.01)

(58) Field of Classification Search

CPC ..... B08B 3/02
See application file for complete search history.

(56) References Cited

U.S. PATENT DOCUMENTS 5,820,658 A * 10/1998 Kim ..... B01D 53/002 95/288
6,171,437 B1 * 1/2001 Shimizu ..... H01L 21/67086 118/728
2012/0156099 A1 * 6/2012 Zhong ..... B82Y 15/00 422/82.02
2013/0256675 A1 * 10/2013 Afentakis ..... H01L 29/66757 257/66

* cited by examiner

*Primary Examiner* — Jason Ko
(74) *Attorney, Agent, or Firm* — WPAT, P.C., Intellectual Property Attorneys; Anthony King

(57) ABSTRACT

An apparatus includes a sprinkler configured for spraying liquid and a member with a nano-coating surface. The nano-coating surface is configured to receive liquid sprayed from the sprinkler. The apparatus further includes a sensor associated with the member and the sensor is configured to detect a signal directly or indirectly corresponding to a film deposition on the nano-coating surface. Moreover, the apparatus has a controller coupled with the sensor and the sprinkler, wherein the signal detected by the sensor is transmitted to the controller and the controller is configured to command the sprinkler spraying liquid on the nano-coating surface while a value of the signal reaches a threshold value.

20 Claims, 5 Drawing Sheets

IN SITU CLEAN APPARATUS AND METHOD THEREOF

FIELD

The present disclosure relates to an in-situ clean apparatus and method thereof.

BACKGROUND

Chemical solutions and gases are used in different industries for manufacturing, however, the exhaust or byproducts produced during the process become a source of environment pollution. Authorities are tending to enforce stricter regulation to push manufacturers improving exhaust emission quality and waste management. A recent trends shows investment on abatement and exhaust system increases from manufacturing in order to meet green policy requirement while still sustain productivity Film deposition or powder are often observed in abatement and exhaust system and mostly are formed because of unexpected reactions. The unexpected reactions usually originate from mixture of different exhaust gas or chemical in certain locations in the systems or an undesired condensation during transportation. To maintain exhaust system and abatement is a challenging topic to a production line because manufacturing equipments are always connected to exhaust system and it is necessary to be moved offline in order to conduct a regular inspection or an ex-situ clean process. Another issue is abrupt malfunction of exhaust system that occurs because an abnormal characteristic parameter or interruptions of power source, such as voltage sag. The abrupt malfunction stops manufacturing equipments and causes product scrap. Thus, in order to maintain a compatible productivity, a robust clean methodology or apparatus for an exhaust system and abatement is continuously to be sought.

BRIEF DESCRIPTION OF THE DRAWINGS

Aspects of the present disclosure are described with reference to the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION OF THE INVENTION

Figure 1:
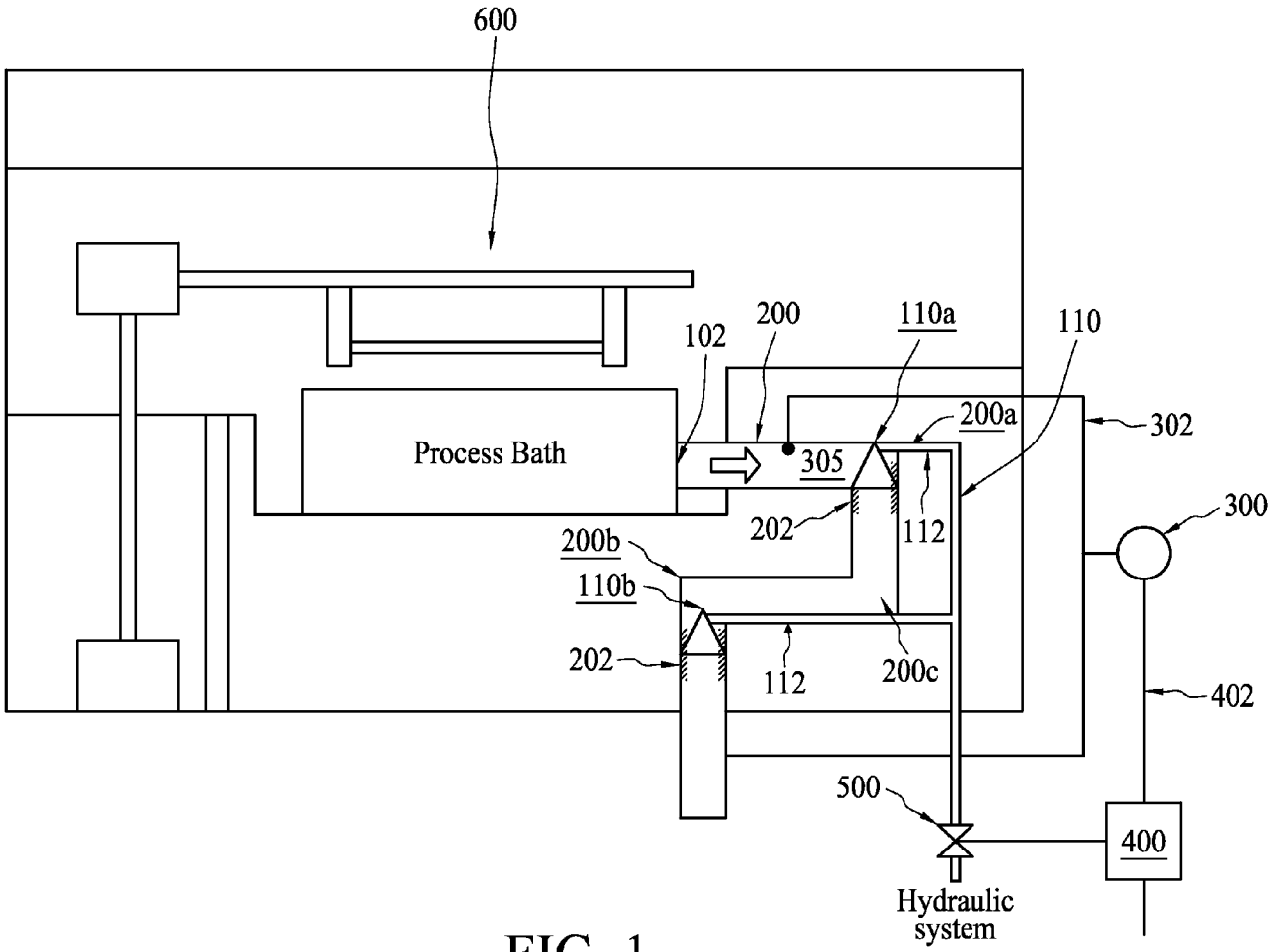
FIG. 1 is an apparatus installed to a wet etch equipment in a semiconductor manufacturing line in accordance with some embodiments of the present disclosure.

The making and using of various embodiments of the disclosure are discussed in detail below. It should be appreciated, however, that the embodiments provide many applicable inventive concepts that can be embodied in a wide variety of specific contexts. The specific embodiments discussed are merely illustrative, and do not limit the scope of the disclosure.

In the present disclosure, an in-situ cleaning apparatus is designed to be located in a system. In some embodiments, the system is an exhaust system. The exhaust system includes various sub systems such as conduit, scrubber, heater, fan, or other parts located in a path that exhaust gas passes. In some embodiments, the exhaust system is designed to be coupled to a semiconductor manufacturing equipments such as a wet etch bench, a deposition chamber, an etch chamber or a photo resist coater, etc. The in-situ cleaning apparatus is configured to automatically remove an undesired film deposition (or called build up) on a location inside the system. In some embodiments, some portions in the system are coated with nano scale particulates on top surface in order to effectively remove undesired film deposition from the portions.

In some embodiments, the in-situ cleaning apparatus is integrated in the system and designed to clean a predetermined location by a programmable controller. The cleaning operation is conducted without interrupting a normal operation of the system. In the present disclosure, "interrupting" or "intervention" of a system refers to an action or actions to shut down the system, in other words, to disable the system. The action or actions includes turning the electric power supplied to the system off, turning the system offline, discharging the system from a semiconductor manufacturing equipment, discharging a portion of the system from the system.

As used herein, "film deposition" refers to a layer or powders formed on a surface. In some embodiments, "film deposition" is interchangeable with "build up". In some embodiments, film deposition is a clog that impedes gas flow in the system. In some embodiments, film deposition is a coating on a turbine blade of a fan. The coating increases load of the fan and alter balance on the turbine blade. Thus, an undesired vibration is observed. Film deposition is formed by various mechanisms in the system. In some embodiments, film deposition is formed by condensation of exhaust gas. In some embodiments, film deposition is formed by undesired reaction of exhaust gases. In some embodiments, film deposition is formed on a bending portion in a system that has turbulent flow.

As used herein, "nano coating" refers to a coating with a creating surface tension at the molecular level. Nano coating includes nano-sized powdered or particle feedstocks or combinations. In some embodiments, nano coating repels water (hydrophobic), while still allowing air to pass through a surface underneath. In some embodiments, nano coating has a thickness between about 40 nm to 250 nm. In some embodiments, nano coating is resistant to elevated temperatures, up to 500° C. In some embodiments, nano coating includes alumina, ceria, chromia, magnesia, silica, titania, yttria, zirconia. In addition to the single component particle feedstocks listed above, mixtures of particle or feedstocks can be employed. For example, mixtures of alumina and chromia, alumina and magnesia, alumina and silica, alumina and titania, chromia and silica and titania, titania and chromia and zirconia and yttria can also be utilized and may have numerous commercial applications. In some embodiments, the nano coating includes cross linking agents, such as $HNO_3$, HCl, $H_2SO_4$.

As used herein, "control valve" is interchangeable with "switch". In some embodiments, a control valve is connected to a hydraulic system and can be regulated by a controller.

FIG. 1 is an apparatus installed to a wet etch equipment 600 in a semiconductor manufacturing line according to some embodiments of the present disclosure. The apparatus includes a sprinkler 110. The sprinkler 110 has two nozzles 110*a* and 110*b* that is respectively connected to a delivery pipe 112. The delivery pipe 112 is further connected to a control valve 500, which controls a hydraulic system used to supply liquid such as water to the nozzles 110*a* and 110*b*. Liquid supplied by the hydraulic system is pressurized in order to maintain a constant flow and speed when the sprinkler 110 is activated. In some embodiments, the pressure is designed in accordance with a hole size of the nozzle. In some embodiments, the hydraulic system supplies a pressure between about 20 psi and 40 psi. In some embodiments, the hydraulic system supplies a pressure at about 30 psi.

In some embodiments, nozzle is arranged based on where liquid is to be sprayed on. As in FIG. 1, a member 200 of the apparatus is an exhaust conduit that is connected to an exhaust outlet 102 of the wet etch equipment 600. The other end of the exhaust conduit 200 is connected to drain, such as a pump, or a local exhaust system. The exhaust conduit 200 has several elbows, such as 200*a*, 200*b* and 200*c*. The elbows are vulnerable to have film deposition because exhaust gas flow stream is impeded therein. Nozzles are installed inside the conduit 200 and around the elbows. Like at elbow 200*a*, a nozzle 110*a* is installed in the conduit 200 around elbow 200*a*. Further, the nozzle 110*a* is configured to spray liquid on internal surfaces of the elbow 200*a*. Similarly, a nozzle 110*b* is installed around elbow 200*b* and the nozzle 110*b* is configured to spray liquid on internal surfaces of the elbow 200*b*. In some embodiments, nozzles are used to spray liquid drops having an average diameter between about 8.5 nm and about 11.2 nm. In some embodiments, nozzles are used to spray liquid drops having an average diameter between about 9 nm and about 10.5 nm. In some embodiments, nozzles are used to spray liquid drops having an average diameter at about 9.2 nm. Another adjustable factor to design the nozzle is distribution of the liquid drop size. In some embodiments, 99.9% of liquid drops sprayed from nozzles have a diameter smaller than about 54 nm. In some embodiments, 99.9% of liquid drops sprayed from nozzles have a diameter smaller than about 53.6 nm. In some embodiments, 99.9% of liquid drops sprayed from nozzles have a diameter smaller than about 60 nm.

In some embodiments, nozzle size is designed incorporative to the liquid pressure. For example, in an embodiment, the sprinkler is connected to a hydraulic system supplying liquid that is pressurized to be around 30 psi. An outlet of the nozzle is designed to be between 800 um and 1000 um. In some embodiments, an outlet of the nozzle is designed to be smaller than 900 um.

Figure 2:
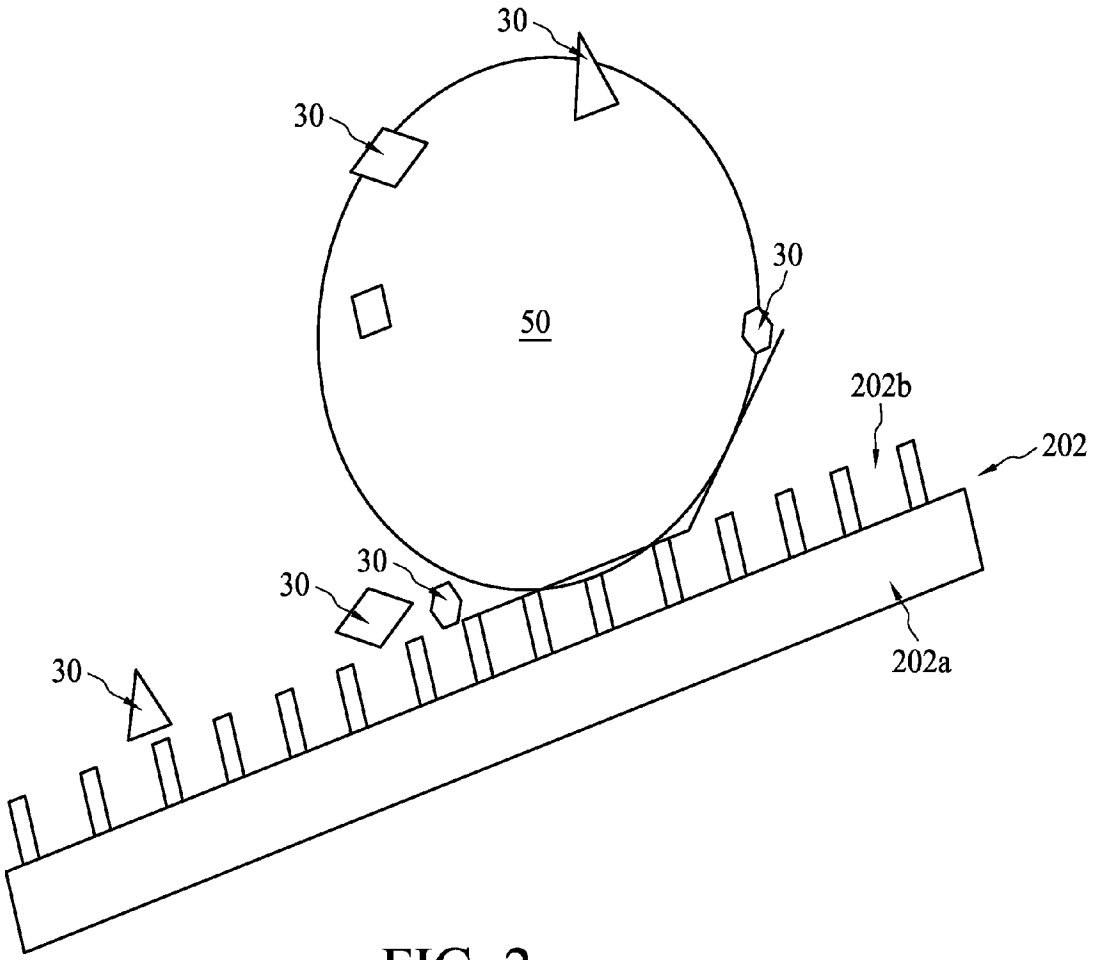
FIG. 2 is a schematic drawing of a nano coating covering the elbows in FIG. 1 in accordance with some embodiments of the present disclosure.

In the apparatus in FIG. 1, inner surfaces of elbows are covered with a nano coating 202. Thus, film deposition or build forms on the top surface of the nano coating. In some embodiments, a portion of the nano coating is illustrated in FIG. 2. The nano coating has a substrate 202*a* with several trenches 202*b*. On the top surface, a chain of nano particulates are used to trap film deposition such as 30. In some embodiments, because the nano particulates are hydrophilic, when liquid such as water drop 50 is sprayed on the nano coating, the film deposition 30 is flushed away.

In some embodiments, the apparatus in FIG. 1 has a sensor 300 coupled to a gauge 305. The gauge 305 is disposed at a predetermined location inside the conduit 200. In the present example, the gauge 305 is located close to the exhaust outlet 102 of wet etch equipment 600. The gauge 305 is associated with the elbows of conduit 200. In some embodiments, gauge 305 is configured to measure pressure inside conduit 200 and transmits a signal to the sensor 300. In some embodiments, gauge 305 measures pressure around exhaust outlet 102 and converts to an electric signal and transmits the electrical signal to the sensor 300. The pressure detected by sensor 300 corresponds to film deposition on nano coating, on where the nano coating 202 is disposed. In some embodiments, when film deposition on elbow 200*a* becomes thicker, higher impedance is generated to block exhaust gas passing elbow 200*a*, thus sensor 300 detects an increased pressure around exhaust outlet 102. In some embodiments, sensor 300 is combined with gauge 305 as an integrated component and disposed inside the conduit 200.

For an external sensor configuration (gauge inside the conduit and sensor disposed outside the conduit), there are various communication paths between sensor and gauge. In some embodiments, as in FIG. 1, gauge 305 communicates with sensor 300 through a wire 302. In some embodiments, gauge 305 communicates with sensor 300 in a wireless manner.

Sensor 300 is coupled to a controller 400 and designed to transmit electrical signal to the controller 400. In some embodiments, sensor 300 transmits electrical signal of the pressure measured by the gauge 200 to controller 400. The controller 400 is connected with sensor 300 through a wire 402. In some embodiments, controller 400 is coupled with sensor 300 through a wireless manner. In some embodiments, the controller 400 is a programmable logic controller (PLC). The PLC is programmed to process various types of signals. In some embodiments, the PLC includes a processor.

According to some embodiments of the present disclosure, the controller 400 is used to regulate the sprinkler 110. As in FIG. 1, a controller 400 is coupled to a control valve 500 of the sprinkler 110. The control valve 500 includes an electronic switch. The control valve 500 is used to regulate liquid supplied from the hydraulic system.

In some embodiments, a method of in-situ cleaning an internal member of an exhaust system is conducted by the apparatus in FIG. 1. Internal members such as elbows 200*a* and 200*b* are identified to be most vulnerable locations to have film deposition. The conduit 200 is disconnected from equipment 600 and applying a nano-coating on an internal surface of each elbow when equipment 600 is in idle. Gauge 305 is installed to monitor ambient condition near elbow 200*a*. In some embodiments, the ambient condition near elbow 200*a* is corresponding to a characteristic condition, such as film deposition around the elbow 200*a*. In some embodiments, gauge 305 measures gas pressure in the conduit 200 and sends an electrical signal to the sensor 300. The electrical signal is processed in sensor 300 and conveyed to the controller 400 in a same or different format by sensor 300. After receiving the electrical signal from the sensor 300, controller 400 compares a characteristic value of the electrical signal to a threshold value. If the characteristic value is greater than the threshold value, controller 400 sends a command to open control valve 500. Liquid is introduced from the hydraulic system into the sprinkler 110, thus nozzles 110*a* and 100*b* spray liquid on nano-coating surface 202 of elbows 200*a* and 200*b*.

In some embodiments, the threshold value is set at around 70 psi, which is about 1.3 times of gas pressure in conduit 200 during normal operation. When film deposition on nano-coating of elbows becomes thicker, gas pressure in conduit 200 is climbing up. Gauge 305 monitors gas pressure in conduit 200 and continuing transmitting signal to controller 400 via sensor 300. As gas pressure in conduit 200 reaches 90 psi, controller 400 regulates the sprinkler 110 to spray water on elbows in order to remove film deposition on nano-coating of elbows. Once the clogged conduit is cleaned, gas pressure in conduit 200 is reduced to be less than about 90 psi. If gauge 305 still sends a gas pressure over 90 psi after clean, another in-situ clean is requested by the controller 400. The cleaning operation is conducted without interrupting normal operation of equipment 600. Thus, exhaust system is cleaned under in-situ mode.

Figure 3:
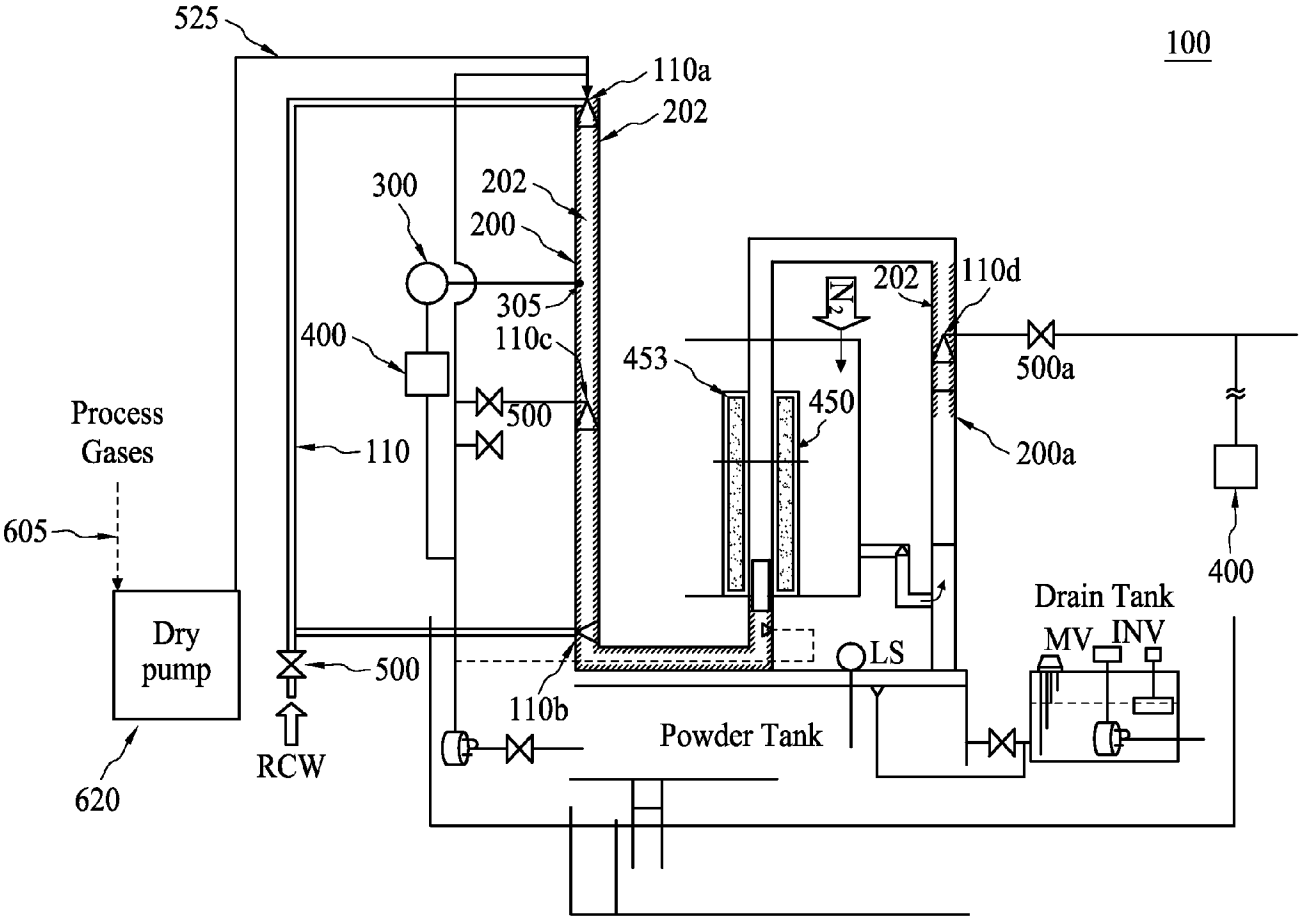
FIG. 3 is a scrubber used as an exhaust system in a semiconductor manufacturing facility in accordance with some embodiments of the present disclosure.

FIG. 3 is a scrubber 100 used as an exhaust system in a semiconductor manufacturing facility. In the present disclosure, "scrubber" refers to a diverse group of air pollution control devices that can be used to remove some particulates and/or gases from industrial exhaust streams. It includes dry scrubber, wet scrubber and hybrid mode scrubber. A "local scrubber" is referred to a scrubber near manufacturing tool. In some embodiments, a local scrubber is connected to an exhaust pump of semiconductor manufacturing equipment. A "central scrubber" is referred to a downstream scrubber that is used to collect exhaust from several local scrubbers. In the present disclosure, scrubber 100 is a local scrubber. Elements with same labeling numbers as those in FIG. 1 are previously discussed with reference thereto and are not repeated here for simplicity.

The scrubber 100 is connected to a dry pump 620. Dray pump 620 is connected to an exhaust conduit 605 of semiconductor manufacturing equipment (not shown). In some embodiments, the semiconductor manufacturing equipment uses gases including chlorine based or fluorine based chemicals. One end of pump 620 is connected to a feeding pipe 525, which guides exhaust gas into the scrubber 100. The scrubber 100 has a conduit 200 connected with a feeding pipe 525. The inner surface of the conduit 200 is covered with a nano-coating 202 through the whole conduit 200. On the other end of the conduit 200, a chamber 450 is connected. The chamber 450 has a heater 453 used to burn unreacted gas in order to reduce pollution. The chamber 450 is connected to another conduit 200*a* at the other end. A portion of the inner surface of the conduit 200*a* is coated with a nano-coating 202.

A pressure gauge 305 is located at a predetermined position in conduit 200. In some embodiments, there are several gauges disposed on different locations according to the requirement. For example, a gauge is disposed in conduit 200*a*. The gauge(s) measure the gas pressure inside conduits and feedback to a sensor 300. As in the aforementioned embodiments, the signal is transmitted from the gauges to sensor in a wire or wireless manner. In some embodiments, gauges are arranged to be near to nozzles 110*a*-110*d*. As in FIG. 3, nozzles are arranged in conduit 200 or 200*a* and designed to be able to spray liquid on the nano-coating 202. In some embodiments, nozzles are arranged at locations where more film deposition is observed. In some embodiments, nozzles are arranged to be near to elbows since most turbulent flow occurs therein. An unexpected reaction of exhaust gas accelerates build up of film depostion. In some embodiments, nozzles are arranged to be near to a cool part of conduits since condensation of exhaust gas transforms into film depostion.

As the film deposition building up in the conduits, pressure in the conduits climbs up. The elevated pressure signal is sent to the sensor 300 from the gauge 305. Once the controller 400 reads a value sent from the sensor 300 and determines that the value is greater than a threshold value, the controller 400 regulates a switch 500 to turn on the nozzle and spray liquid on nano-coating surface. In some embodiments, there are more than one zone and each zone such as conduit 200 and conduit 200*a* respectively has an independent gauge installed. The sensor 300 collects signals from different zones and transmits the signals to the controller 400. The controller 400 processes the signals and determines that which zone's pressure is greater than the threshold value. Then the controller 400 regulates the switch corresponding to that specific zone. For example, when a gauge in conduit 200*a* sends a pressure signal greater than the threshold value and a gauge 305 in conduit 200 sends a pressure signal less than the threshold value, controller 400 only turns switch 500*a* on.

Figure 4:
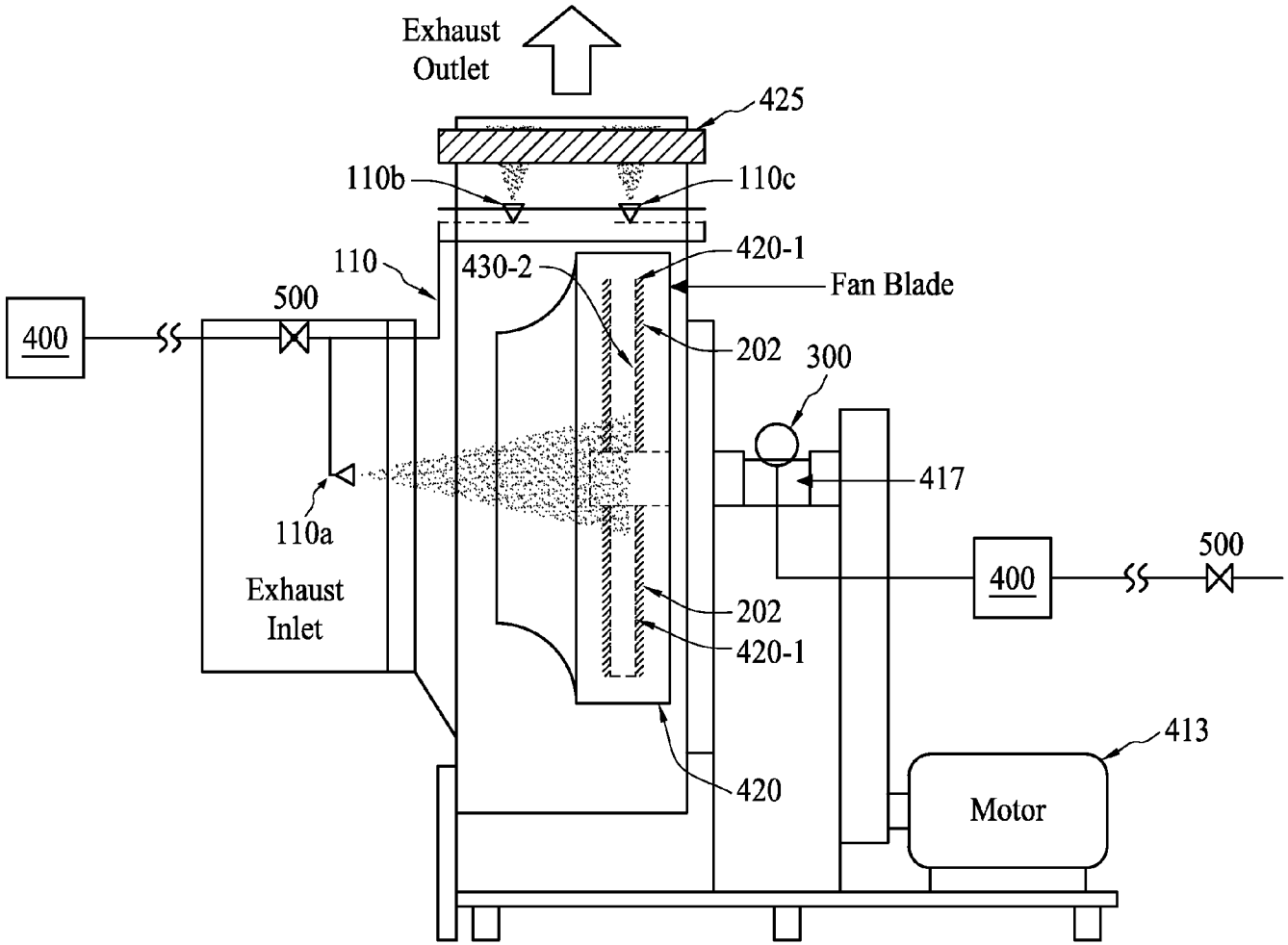
FIG. 4 is an exhaust system in a semiconductor manufacturing facility in accordance with some embodiments of the present disclosure.

FIG. 4 is an exhaust system located in a manufacturing site. The exhaust system has a turbine 420 driven by a motor 413. The turbine 420 includes several blades 420-1. FIG. 4 is a side view of the turbine hence only a housing 420-2 of the turbine 420 is observed. Turbine blades 420-1 are enclosed in the housing 420-2 thus are depicted with dotted lines. The turbine 420 is used to draw air from an exhaust inlet and push air out to an exhaust outlet. Because the air contacts the top surface of each blade directly, film deposition is easily observed. The top surface of each blade is covered by nano-coating 202 such that any film deposition is attached on the nano-coating 202. A sensor 300 is installed on a shaft 417 of the turbine 420. In some embodiments, sensor 300 is a vibration sensor. The sensor 300 is used to detect a characteristic condition such as vibration of the shaft 417 and blades 420-1, wherein the vibration is associated with balance and load of the turbine blades 420-1.

As film deposition starts building on the blades 420-1, balance and load are changed. The sensor 300 periodically measures vibration of the shaft 417 and transmits an electrical signal associated with the measured vibration to a controller 400. In some embodiments, the electrical signal is transmitted to the controller 400 in a wireless manner. The controller 400 compares the electrical signal to determine if vibration of the turbine blades 420-1 is greater than a threshold value. When vibration of the turbine blades 420-1 is smaller than the threshold value, the valve or switch 500 is closed. When vibration of the turbine blades 420-1 is greater than the threshold value, the controller 400 sends a command to open the valve or switch 500. Liquid from a hydraulic system is introduced into a sprinkler 110 and nozzle 110*a* to spray liquid on the nano-coating turbine blades 420-1. An in-situ clean is conducted by removing film deposition from blades 420-1. Turbine 420 is continuous in normal operation without any intervention during the in-situ clean operation. Sensor 300 constantly sends vibration signal to the controller 400. Once the controller 400 discovers that the characteristic condition, vibration, of blades 420-1 are reduced under the threshold value, the switch 500 is closed by a command from the controller 400.

Some nozzles such as 110*b* and 110*c* are installed near a damper 425 of the system. The damper 425 is used to adjust the outlet flow and is another member that is vulnerable to film deposition. In some embodiments as in FIG. 4, nozzles 110*b* and 110*c* share a same switch 500 with nozzle 110*a*. The damper 425 is in-situ cleaned simultaneously with the blades 420-1. In some embodiments, nozzles 110*b* and 110*c* are connected to a separate switch that is coupled with the controller 400. The controller 400 controls multiple switches and regulate sprinkler in different zone independently.

In some embodiments, a controller is combined with a sensor to become an integral part. Housing is used to accommodate the controller and the sensor together. The integral part has a wireless connection port in order to operation in a remote mode.

Figure 5:
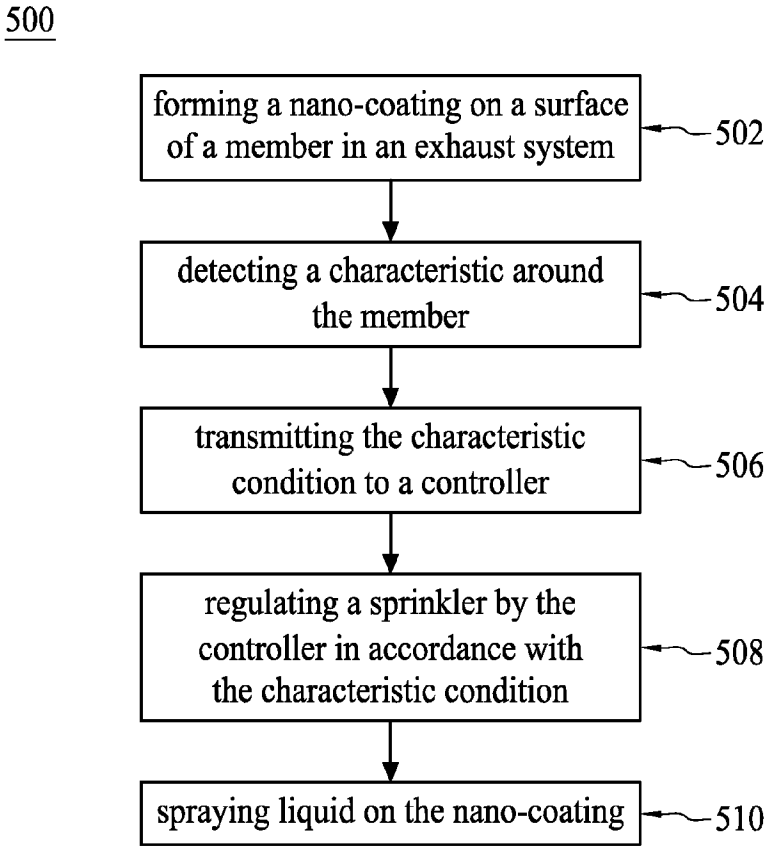
FIG. 5 is flowchart of an in-situ exhaust system cleaning method in accordance with some embodiments of the present disclosure.

FIG. 5 is a flow diagram of an in-situ method 500 used to clean an exhaust system without interrupting a normal operation of the exhaust system. The method 500 includes an operation 502. In operation 502, a nano-coating is formed on a surface of a member in the exhaust system. In some embodiments, the member to be coated is a part or component most vulnerable to film deposition. During a regular maintenance or system fault recovery, the surface condition of the member can be observed to determine if the member is under a sever environment to have film deposited. In operation 504, a characteristic condition around the member is detected. In some embodiments, the characteristic condition includes gas pressure, vibration. The characteristic condition is detected or measured by a sensor. In some embodiments, the sensor detects the characteristic condition indirectly through a gauge. In some embodiments, the sensor detects the characteristic condition in a wireless manner.

In operation 506, the characteristic condition in transmitted to a controller from the sensor. The transmission is by a wire or wireless manner. In operation 508, a sprinkler is regulated by the controller in accordance with the characteristic condition. In operation 510, liquid is sprayed on the nano-coating. In some embodiments, the sprinkler is turned on by the controller. In some embodiments, the controller compares the characteristic condition with a threshold value. If the characteristic condition is greater than the threshold, the controller commands to turn on the sprinkler.

An apparatus includes a sprinkler configured for spraying liquid and a member with a nano-coating surface. The nano-coating surface is configured to receive liquid sprayed from the sprinkler. The apparatus further includes a sensor associated with the member and the sensor is configured to detect a signal directly or indirectly corresponding to a film deposition on the nano-coating surface. Moreover, the apparatus has a controller coupled with the sensor and the sprinkler, wherein the signal detected by the sensor is transmitted to the controller and the controller is configured to command the sprinkler spraying liquid on the nano-coating surface while a value of the signal reaches a threshold value.

An apparatus is configured to be installed in an exhaust system and the apparatus includes a member. The member is an exhaust pipe with a nano-coating surface. The nano coating surface is an inner surface of the exhaust pipe.

An apparatus is configured to be installed in an exhaust system and the apparatus includes a member. The member is a local scrubber, a central scrubber, a conduit connected to semiconductor wafer manufacturing equipment, a turbine blade in an exhaust system, a damper, a bevel, an exhaust pipe, a inner surface of a dry pump.

A system includes an in-situ cleaning apparatus located in the system. The in-situ cleaning apparatus is configured to automatically remove an undesired film deposition on a location inside the system without intervention. The in-situ cleaning apparatus includes a nano-coating film on the location and a nozzle configured to spray liquid on the nano-coating film. The in-situ cleaning apparatus includes a sensor configured for monitoring a characteristic condition around the location and a controller configured to receive a signal from the sensor and process the signal to generate a result. In some embodiments, the controller is configured to regulate the nozzle in accordance with the result generated by the controller.

A system includes an in-situ cleaning apparatus located in the system. The in-situ cleaning apparatus is configured to automatically remove an undesired film deposition on a location inside the system without intervention. The location is near an exhaust outlet of semiconductor equipment, wherein the exhaust outlet is configured to receive exhaust gas from the semiconductor equipment.

A system includes an in-situ cleaning apparatus located in the system. The in-situ cleaning apparatus is configured to automatically remove an undesired film deposition on a location inside the system without intervention. The in-situ cleaning apparatus includes a nano-coating film on the location and a nozzle configured to spray liquid on the nano-coating film. The nozzle is connected to a hydraulic system.

A system includes an in-situ cleaning apparatus located in the system. The in-situ cleaning apparatus is configured to automatically remove an undesired film deposition on a location inside the system without intervention. The in-situ cleaning apparatus includes a nano-coating film on the location and a nozzle configured to spray liquid on the nano-coating film. The nozzle is connected to a hydraulic system and designed to spray liquid drops, and an average diameter of the liquid drops is between about 8.5 nm and about 11.2 nm.

A system includes an in-situ cleaning apparatus located in the system. The in-situ cleaning apparatus is configured to automatically remove an undesired film deposition on a location inside the system without intervention. The in-situ cleaning apparatus includes a nano-coating film on the location and a nozzle configured to spray liquid on the nano-coating film. The nozzle is connected to a hydraulic system and designed to spray liquid drops having a size distribution of 99.9% of the liquid drops is to have a diameter smaller than about 54 nm.

A system includes an in-situ cleaning apparatus located in the system. The in-situ cleaning apparatus is configured to automatically remove an undesired film deposition on a location inside the system without intervention. The in-situ cleaning apparatus includes a nano-coating film. The nano-coating film includes silicon oxide An in-situ cleaning method includes forming a nano-coating on a surface of a member in an exhaust system and detecting a characteristic condition near the member. The in-situ cleaning method includes transmitting the characteristic condition to a controller and regulating a sprinkler by the controller in accordance with the characteristic condition. The in-situ cleaning method includes spraying liquid on the nano-coating.

An in-situ cleaning method includes comparing the characteristic condition with a threshold value.

Although the present invention and its advantages have been described in detail, it should be understood that various changes, substitutions and alterations cancan be made herein without departing from the spirit and scope of the invention as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An apparatus, comprising:

a sprinkler configured for spraying liquid;

a conduit with a nano-particle coated surface, wherein the nano-particle coated surface is configured to receive liquid sprayed from the sprinkler;

a sensor associated with the conduit, wherein the sensor is configured to detect a signal directly or indirectly corresponding to a film deposition on the nano-particle coated surface; and a controller coupled with the sensor and the sprinkler, wherein the signal detected by the sensor is transmitted to the controller and the controller is configured to regulate the sprinkler spraying liquid on the nano-particle coated surface while a value of the signal reaches a threshold value.

2. The apparatus of claim 1, wherein the controller further comprises a PLC (Programmable Logic Controller).

3. The apparatus of claim 1, wherein the conduit is an exhaust conduit and the nano-particle coated surface is an inner surface of the exhaust conduit.

4. The apparatus of claim 1, wherein the conduit is in a scrubber.

5. The apparatus of claim 1, wherein the conduit includes a turbine blade.

6. The apparatus of claim 1, wherein the conduit includes a bevel in an exhaust conduit.

7. The apparatus of claim 1, wherein the conduit includes a damper in an exhaust conduit.

8. The apparatus of claim 1, wherein the sensor is a pressure sensor, the pressure sensor is configured to detect air pressure around the conduit and transmit the detected air pressure to the controller.

9. The apparatus of claim 1, wherein the sensor is a vibration sensor, the vibration sensor is configured to detect the vibration occurred on the conduit and transmit a magnitude of the detected vibration to the controller.

10. The apparatus of claim 1, wherein the signal detected by the sensor is transmitted to the controller in a wireless manner.

11. The apparatus of claim 1, wherein the conduit includes glass, iron, epoxy, fiber reinforced plastic (FRP), or combination thereof.

12. The apparatus of claim 3, wherein the sprinkler sprays the liquid on the inner surface of an elbow of the exhaust conduit.

13. The apparatus of claim 3, further comprising:

a nozzle installed around an elbow of the exhaust conduit.

14. The apparatus of claim 13, further comprising:

a delivery pipe connected to the nozzle.

15. The apparatus of claim 14, further comprising:

a control valve connected to the delivery pipe, wherein the control valver is controlled by the controller.

16. The apparatus of claim 15, wherein the control valve is arranged to regulate the liquid in the delivery pipe.

17. The apparatus of claim 3, wherein the threshold value is about 1.3 times of gas pressure in the exhaust conduit.

18. The apparatus of claim 3, further comprising:

a gauge arranged to measure pressure of the exhaust conduit and transmit a signal corresponding to the pressure to the sensor.

19. The apparatus of claim 18, wherein the gauge is disposed inside the exhaust conduit.

20. The apparatus of claim 18, wherein the pressure of the exhaust conduit corresponds to the film deposition on the nano-particle coated surface.

* * * * *